US008717184B2

(12) United States Patent
Aebersold et al.

(10) Patent No.: US 8,717,184 B2
(45) Date of Patent: May 6, 2014

(54) CALIBRATION OF AN ELECTRO-OPTICAL SIGNAL PATH OF A SENSOR DEVICE BY ONLINE SIGNAL LEVEL MONITORING

(75) Inventors: Hans Aebersold, Bonstetten (CH); Ke Wei Bi, Beijing (CN); Hu Lin Wang, Beijing (CN)

(73) Assignee: Siemens Aktiengesellschaft, Munich (DE)

( * ) Notice: Subject to any disclaimer, the term of this patent is extended or adjusted under 35 U.S.C. 154(b) by 515 days.

(21) Appl. No.: 12/905,544

(22) Filed: Oct. 15, 2010

(65) Prior Publication Data

US 2012/0092176 A1 Apr. 19, 2012

(51) Int. Cl.
*G08B 17/107* (2006.01)

(52) U.S. Cl.
USPC ..... 340/628; 340/611; 340/512; 340/527; 340/630; 250/574; 356/438

(58) Field of Classification Search
CPC .... G08B 17/10; G08B 17/103; G08B 17/107; F21V 33/0076; G01V 8/00; G01V 8/12; G01V 8/10; G01M 11/0292; G01M 15/108
USPC ..... 340/5.1, 6.1, 630, 628; 250/574; 356/438
See application file for complete search history.

(56) References Cited

U.S. PATENT DOCUMENTS

| | | | | |
|---|---|---|---|---|
| 5,497,144 | A * | 3/1996 | Schappi et al. | 340/630 |
| 6,396,405 | B1 * | 5/2002 | Bernal et al. | 340/630 |
| 7,061,369 | B2 * | 6/2006 | Bergerhoff | 340/5.61 |
| 7,440,100 | B2 * | 10/2008 | Siemens | 356/338 |
| 2006/0007010 | A1 | 1/2006 | Mi et al. | |

FOREIGN PATENT DOCUMENTS

| | | | |
|---|---|---|---|
| EP | 0 658 264 | B1 | 4/1998 |
| JP | 06168388 | A | 6/1994 |
| JP | 06201582 | A | 7/1994 |
| JP | 2790952 | B2 | 8/1998 |
| JP | 11339159 | A | 12/1999 |
| WO | 95/02230 | A1 | 1/1995 |

* cited by examiner

*Primary Examiner* — Daniel Wu
*Assistant Examiner* — Benyam Haile
(74) *Attorney, Agent, or Firm* — Laurence A. Greenberg; Werner H. Stemer; Ralph E. Locher

(57) ABSTRACT

A sensor device detects an object, in particular for optically detecting smoke particles. The sensor device contains a transmitting device for emitting transmit radiation, a receiving device for receiving receive radiation having scattering radiation that is generated by an at least partial scattering of the transmit radiation by the object, and for outputting a measurement signal indicative of the receive radiation, a signal modification device for modifying the measurement signal and for outputting a modified measurement signal, a level of the modified measurement signal increasing after the transmitting device has been switched on, and a calibration device for monitoring the modified measurement signal. The calibration device is embodied such that a reaching of a predefined signal level for the modified measurement signal can be detected and that a time interval between the switching on of the transmitting device and the reaching of the predefined signal level can be determined.

16 Claims, 2 Drawing Sheets

CALIBRATION OF AN ELECTRO-OPTICAL SIGNAL PATH OF A SENSOR DEVICE BY ONLINE SIGNAL LEVEL MONITORING

BACKGROUND OF THE INVENTION

Field of the Invention

The present invention relates generally to the technical field of building security. The present invention relates in particular to a sensor device for detecting an object, in particular for optically detecting smoke particles. The present invention furthermore relates to a hazard detector for detecting a hazardous situation, in particular for detecting smoke in a space that is being monitored. The present invention relates in addition to a method for calibrating a sensor device of this kind.

Optical or photoelectric smoke detectors normally operate according to the well-known scattered light principle. Such devices exploit the fact that clear air reflects practically no light. However, if smoke particles are present in a measurement chamber, an illuminating light emitted by a light source will be at least partially scattered by the smoke particles. Some of the scattered light then impinges upon a light detector which is arranged relative to the light source in such a way that it will not be struck directly by the illuminating light. In the absence of smoke particles in the measurement chamber the illuminating light therefore cannot reach the light detector.

The light detector of an optical smoke detector is typically a photodiode which supplies only a very small measurement signal. The photodiode supplies an output current whose intensity is dependent on the incident light intensity. The intensity of the light impinging on the photodiode is dependent, inter alia, on the intensity of the illuminating light emitted by the light source, on the geometry of the smoke detector, and on the density of the smoke particles in the measurement chamber.

An electronic amplifier circuit which converts a current provided by the photodiode into a voltage and amplifies the voltage such that the signal can be processed further by a succeeding system is typically connected downstream of the photodiode. The succeeding system includes, for example, an analog-to-digital converter and a microcontroller for further signal processing.

In order to ensure reliable triggering of an alarm on the one hand and a low false alarm rate of an optical smoke detector on the other it is generally necessary to calibrate an electro-optical signal path of an optical smoke detector prior to putting the smoke detector into service. Furthermore, a calibration of the electro-optical signal path of the kind should also be carried out at regular maintenance intervals so that reliable alarm triggering and a low false alarm rate can also be guaranteed even during a protracted period of operation of the optical smoke detector.

By a calibration, often also referred to as a fine adjustment, inevitable deviations from a nominal behavior of components of the electro-optical signal path that are characterized by a certain tolerance can be compensated, for example. Deviations of the kind arise in practice in particular in relation to the efficiency of the light source, the control of the light source, and/or the amplification of the amplifier circuit.

The electro-optical signal path of an optical smoke detector contains (a) a light source, for example a light-emitting diode, for emitting an illuminating light, (b) a measurement chamber into which scattering smoke particles can penetrate, (c) a light detector, for example a photodiode, for detecting illuminating light scattered by smoke particles that have penetrated into the chamber, (d) an amplifier circuit connected downstream of the light detector, and (e) a microcontroller connected downstream of the amplifier circuit for the purpose of analyzing the detected scattered light signals and for controlling or regulating the light source.

In order to calibrate an optical smoke detector or, as the case may be, its electro-optical signal path use can be made of a scattering body introduced into the measurement chamber, the body simulating a defined density of smoke particles corresponding to an alarm state. Subsequently the intensity of the illuminating light is varied, for example through adjustment of pulse durations of illuminating light pulses emitted by the light source, until a predefined signal swing required for tripping the alarm of the optical smoke detector is reached by the amplifier circuit. The use of a scattering body of this kind is described for example in European patent EP 0 658 264 B1, corresponding to U.S. Pat. No. 5,497,144.

Typically, at least 3-4 pulse cycles are iteratively applied to the light source in order to achieve a precise calibration. However, the pulse cycles cannot be repeated arbitrarily quickly since it is necessary in the interim for the light source in question to cool down again and for the amplifier circuit used to stabilize to a steady state again. Consequently the calibration of the electro-optical signal path of an optical smoke detector is time-consuming. This leads to longer production times and to an increase in the production costs for optical smoke detectors.

SUMMARY OF THE INVENTION

It is accordingly an object of the invention to provide a calibration of an electro-optical signal path of a sensor device by online signal level monitoring which overcome the above-mentioned disadvantages of the prior art methods and devices of this general type, which improves the calibration of optical hazard detectors.

According to a first aspect of the invention a sensor device for detecting an object, in particular for optically detecting smoke particles, is described. The sensor device contains a transmitting device for emitting transmit radiation, a receiving device for receiving receive radiation which has scattered radiation that is generated as a result of an at least partial scattering of the transmit radiation by the object, and for outputting a measurement signal that is indicative of the receive radiation, and a signal modification device for modifying the measurement signal and for outputting a modified measurement signal. A level of the modified measurement signal increases after the transmitting device has been switched on. The sensor device further has a calibration device for monitoring the modified measurement signal. The calibration device is embodied in such a way that a reaching of a predefined signal level for the modified measurement signal can be detected and that a time interval between the transmitting device being switched on and the predefined signal level being reached can be determined.

The sensor device described is based on the knowledge that a calibration of the electro-optical signal path of the sensor device can be performed in a particularly simple manner by an "online" monitoring of the signal level of the modified measurement signal. According to the invention, namely, a time interval for an activation of the transmit radiation that is necessary in order to reach a specific minimum level at an output of the electro-optical signal path is simply determined, which output is required during the operation of the sensor device for reliable object detection and in particular for reliable smoke detection. During real operation of the sensor device the transmitting device can then be activated and controlled in a pulsed manner, the duration of the activation of the transmitting device corresponding to the determined time interval between the switching on of the transmitting device and the reaching of the predefined signal level. The electro-optical signal path can therefore be calibrated in an advantageous manner already with a one-time activation of the transmitting device. Advantageously, a time-consuming and cost-intensive iterative procedure in which it is necessary to switch the transmitting device on and off multiple times is thus no longer required.

The term "activation" is to be understood in this context to mean that the transmitting device is in a switched-on state during the time of the activation and accordingly emits transmit radiation.

The electro-optical signal path of the sensor device according to the invention can therefore be calibrated by a method that can be performed simply and quickly. As a result the sensor device can be manufactured much faster and the manufacturing costs can be substantially reduced. Accordingly it is in particular no longer necessary for the mass production of sensor devices according to the invention to use a plurality of calibration stations simultaneously, as is necessary for efficient high-speed production in the case of known sensor devices that require a time-consuming calibration. Therefore at least some of the calibration stations being operated simultaneously or in parallel can be economized and acquisition costs for the setting up of a mass production facility for sensor devices can be saved. A reduction in acquisition costs of this kind obviously has a favorable impact in terms of a reduction in manufacturing costs, since the acquisition costs have to be amortized by way of the product price charged for the sensor devices.

The measurement signal output by the receiving device can be indicative for example of the intensity of the measurement radiation impinging on the receiving device.

The term "radiation", in the context of the present document, is to be understood to mean electromagnetic radiation having arbitrary wavelengths. In particular the electromagnetic radiation can be light in the visible, infrared (IR) or ultraviolet (UV) spectral range. In addition to a comparatively narrowband spectral range or even a monochromatic radiation the electromagnetic radiation can also have different wavelengths which represent a continuous spectrum or different narrowband and/or wideband spectral ranges that are separate from one another. The electromagnetic radiation can also have wavelengths that are assigned to the far-IR and/or far-UV spectral range. Microwave radiation or any other type of electromagnetic radiation can basically be used as transmit radiation and correspondingly also as receive radiation. In an analogous manner the term "optical" is intended to refer to all cited spectral ranges of electromagnetic radiation and by no means only to the visible spectral range.

According to an exemplary embodiment of the invention the signal modification device has an integrating entity.

For example, the signal modification device can be an integrating photomultiplier by which the receive radiation can be integrated over an entire pulse length of a transmit radiation pulse emitted by the transmitting device. This has the advantage that compared to the use of a known transimpedance amplifier a considerably lower amplification can be chosen, which means that the entire signal processing of the optical sensor device can be implemented so as to be much more robust and/or much less susceptible to interference.

The integrating entity can be implemented for example by an integrating electronic circuit. It is, however, pointed out that the integrating entity can also be realized by a software component which, when executed by a processor, calculates an output signal which represents a time integral of the modified measurement signal. Furthermore the integration can also be implemented in hybrid form, i.e. by software components and hardware components.

Using an integrating entity also has the advantage that after the transmitting device has been switched on the modified measurement signal, which represents the output signal of the signal modification device, is strictly monotonously rising, at least up to a designated readout time, or, if possibly no receive radiation should momentarily impinge on the receiving device, at least monotonously rising. This has the advantage that the predefined signal level can be reliably detected by the calibration device and a reliable calibration of the electro-optical signal path can be realized by a correspondingly reliable determination of the time interval between the switching on of the transmitting device and the reaching of the predefined signal level.

According to a further exemplary embodiment of the invention the integrating entity has a capacitor or capacitance. This has the advantage that the integrating entity can easily be implemented by a simple electronic circuit having a very inexpensive electronic component. This in turn reduces the material costs for producing the overall sensor device.

Furthermore, using a capacitor enables a continuous integration of the modified measurement signal, which typically is an analog signal, in a simple manner.

A possible temperature dependence of the integrating electronic circuit implemented by a capacitor can result in the modified measurement signal reaching a signal level or a signal maximum which is also dependent, inter alia, on the current temperature. However, temperature influences of this kind can be compensated by a close-meshed monitoring of the modified measurement signal over time, with a maximum signal level always being reliably detected.

The capacitor can be, for example, a discrete capacitor which is separate from other electronic components of the integrating electronic circuit such that the discrete capacitor and the other electronic components are not implemented together in an integrated circuit. This in turn reduces the material costs for producing the overall sensor device.

The capacitor or capacitance can also be implemented in an application-specific integrated circuit (ASIC) and/or in a microcontroller having an analog function.

According to a further exemplary embodiment of the invention the signal modification device has an amplifying electronic circuit. Even if only a small amplification is necessary owing to the above-described use of an integrating electronic circuit, this enables the signal processing to be performed with amplified signal levels which permit reliable (further) signal processing by virtue of their signal amplitude.

According to a further exemplary embodiment of the invention the calibration device has an analog-to-digital converter by which the modified measurement signal can be sampled.

Using an analog-to-digital converter (ADC) has the advantage that the reaching of the predefined signal level can be checked using digital data. This allows a particularly reliable determination of the time interval between the switching on of the transmitting device and the reaching of the predefined signal level and consequently also a particularly reliable calibration of the electro-optical signal path.

In a sensor device that is suitable for optically detecting smoke particles the time interval between the switching on of the transmitting device and the reaching of the predefined signal level can amount to approximately 10 to 200 μs, for example.

As already described above, the time interval corresponds to the pulse duration with which the transmitting device should be activated during the operation of the sensor device in order to allow reliable object detection. The sampling rate of the ADC should be sufficiently high so as not to miss the reaching of the predefined signal level even in the case of a comparatively steep rise of the modified measurement signal. In the case of a sensor device used for a smoke detector the sampling rate can be equivalent to approximately 1 MHz, for example.

According to a further exemplary embodiment of the invention the calibration device has a control unit which is coupled to the transmitting device and which is embodied in such a way that the transmitting device can be operated by a pulsed control signal, the respective pulse durations being correlated with the specific time interval between the switching on of the transmitting device and the reaching of the predefined signal level.

The control unit can have, for example, a driver circuit which converts a voltage curve of the pulsed control signal into a suitable current profile of the pulsed control signal, the corresponding current flowing through the transmitting device during the operation of the sensor device.

According to a further exemplary embodiment of the invention the transmitting device has a light-emitting diode.

Using a light-emitting diode (LED) has the advantage that the transmitting device can be implemented using an inexpensive optoelectronic component which in addition exhibits a high degree of energy efficiency. Therefore even with a low level of electric power consumption a light-emitting diode can emit a high intensity of transmit radiation or transmit light. The sensor device described can therefore be operated with a low energy requirement. In the case of battery operation this can provide a long battery life.

The light-emitting diode is preferably a light-emitting diode emitting light in the infrared spectral range (IRED). Using an IRED has the advantage that the transmit radiation has infrared light which can be generated with a particularly high degree of energy efficiency and which furthermore is scattered well by many objects, in particular by smoke.

The light-emitting diode can be configured in particular in such a way that pulsed transmit radiation can be emitted.

Advantageously, only one drive pulse is henceforth required for a calibration in order to calibrate the electro-optical signal path for the sensor device described. In this case the LED or, as the case may be, the IRED is switched on and the modified measurement signal output by the signal modification device, which can be a conventional photomultiplier for example, is cyclically sampled. This then happens in any event until such time as the modified measurement signal has reached the required target signal swing. Thereafter the LED or IRED can be switched off. The required duty cycle or switch-on time of the LED or IRED then corresponds to the calibrated pulse length of the LED or IRED.

It is pointed out that the transmitting device can also have a plurality of light-emitting diodes. In this case each of the light-emitting diodes can contribute toward emitting a particularly strong or intensive transmit radiation overall.

According to a further exemplary embodiment of the invention the receiving device has a photodiode. This has the advantage that the receiving device can be implemented using a simple and in particular inexpensive optoelectronic component. The described receiving device therefore represents an optical device having a high degree of electromagnetic compatibility which is also well suited to what are referred to as "low cost" applications.

The photodiode can have a spectral sensitivity that is optimized for the requirements present in a particular case. In particular in order to use the sensor device for an optical smoke detector the photodiode can have a high sensitivity in the near-infrared spectral range, where simple light-emitting diodes that are typically used as light sources exhibit a particularly high degree of efficiency.

It is pointed out that the receiving device can also have a plurality of photodiodes, each of which is coupled to the above-described signal modification device.

According to a further aspect of the invention a hazard detector for detecting a hazardous situation, in particular for detecting smoke in a monitored space, is described. The described hazard detector has a sensor device of the above-described type.

The described hazard detector is also based on the knowledge that a calibration of the electro-optical signal path can be performed in a simple and in particular an expeditious manner by "online" monitoring of the signal level of the modified measurement signal. In this case a time interval is simply determined within which the transmit radiation must be emitted by the transmitting device in order to reach a predefined target signal swing at an output of the electro-optical signal path, the target signal swing being required for reliable object detection and in particular for reliable smoke detection during the operation of the sensor device.

According to a further aspect of the invention a method for calibrating a sensor device for detecting an object, in particular for optically detecting smoke particles, is described. The described method includes (a) switching on a transmitting device so that transmit radiation is emitted, (b) receiving receive radiation which has a scattered radiation that is generated by an at least partial scattering of the transmit radiation by the object, (c) outputting a measurement signal which is indicative of the receive radiation, (d) modifying the measurement signal so that a level of the modified measurement signal increases, (e) monitoring the modified measurement signal, a reaching of a predefined signal level for the modified measurement signal being detected, and (f) determining a time interval between the switching on of the transmitting device and the reaching of the predefined signal level.

The described method is based on the knowledge that the electro-optical signal path can be calibrated in a simple, efficient and expeditious manner by determining the time interval within which the receive radiation or, as the case may be, the scattered transmit radiation must impinge upon the radiation receiver in order to reach a predefined signal level of the steadily increasing modified measurement signal. Advantageously, only one switch-on pulse is required for the radiation source in order to perform the described calibration method, which means that in comparison with known calibration methods for optical smoke detectors, for example, the calibration of the electro-optical signal path can be completed much more quickly. With known calibration methods it is namely necessary as a rule to use a plurality, for example three to four, iterative pulse cycles by which the radiation source is activated and controlled in order to achieve reliable calibration of the electro-optical signal path.

According to a further exemplary embodiment of the invention the method additionally includes introducing a scattering reference object into a measurement space of the sensor device so that the reference object will be struck by the transmit radiation and will generate the receive radiation.

The reference object can in principle be any arbitrary scattering body by which the transmit radiation is scattered, thereby generating the receive radiation. In the case of the calibration of the electro-optical signal path of a smoke detector, the reference object can have a scattering behavior for electromagnetic radiation that corresponds to the scattering behavior of a defined quantity or, as the case may be, concentration of smoke particles.

It is pointed out that embodiment variants of the invention have been described with reference to different inventive objects. In particular, some embodiment variants of the invention are described by device claims and other embodiment variants of the invention by method claims. However, it will become immediately apparent to the person skilled in the art when reading the present application that, unless explicitly stated otherwise, in addition to a combination of features that belong to one type of inventive object, any combination of features belonging to different types of inventive objects is also possible.

Other features which are considered as characteristic for the invention are set forth in the appended claims.

Although the invention is illustrated and described herein as embodied in a calibration of an electro-optical signal path of a sensor device by online signal level monitoring, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Further advantages and features of the present invention will emerge from the following exemplary description of currently preferred embodiment variants. The individual figures of the drawing of this application are simply to be regarded as schematic and are not to be considered true to scale.

DETAILED DESCRIPTION OF THE INVENTION

It is pointed out that features and/or components of different embodiment variants that are identical or at least functionally identical to the corresponding features and/or components of the embodiment variant according to are labeled with the same reference signs or with other reference signs that differ only in the first digit from the reference sign of a corresponding component. In order to avoid unnecessary repetitions, features and/or components already explained with reference to a previously described embodiment variant will not be explained in detail again at a subsequent point.

It is furthermore pointed out that the embodiment variants described herein below represent only a limited selection of possible embodiment variations of the invention. In particular it is possible to combine the features of individual embodiment variants with one another in a suitable way so that with the embodiment variations explicitly presented here a multiplicity of different embodiment variants shall be regarded as obviously disclosed in the eyes of a person skilled in the art.

Figure 1:
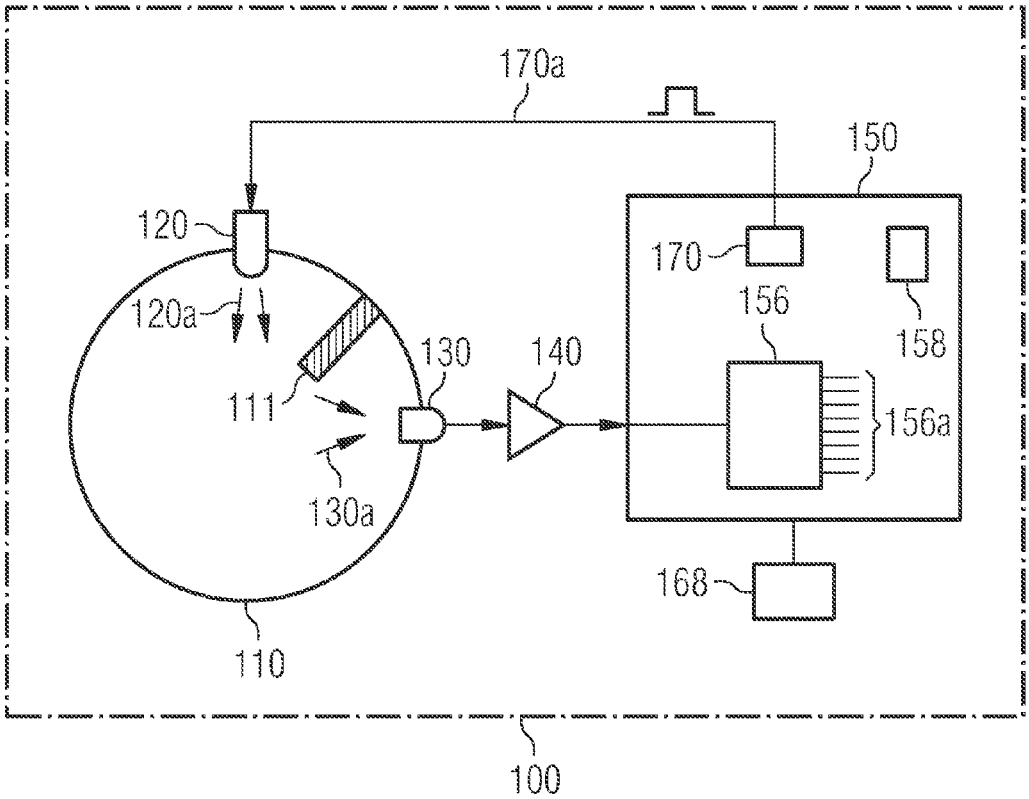
FIG. 1 is an illustration of a smoke detector based on an optical scattered light principle according to an exemplary embodiment of the invention.

Referring now to the figures of the drawing in detail and first, particularly, to FIG. 1 thereof, there is shown a smoke detector 100 based on the optical scattered light principle. The smoke detector has a measurement chamber 110 into which smoke penetrates during a fire, for example. The measurement chamber is also referred to as a scattering volume 110. Contained in the measurement chamber 110 is a light or radiation source 120 which is embodied as a photodiode and to which control pulses are applied by way of a control line 170*a*, and which accordingly is induced to emit a pulsed illuminating light 120*a*. Also present in the edge region of the measurement chamber 110 is a light detector 130 which is embodied as a photodiode and receives a measurement light 130*a* which strikes the light detector 130 following an at least partial scattering of the illuminating light 120*a* by smoke particles. An optical barrier 111 prevents the illuminating light 120*a* from striking the light detector 130 directly, i.e. without scattering.

Connected downstream of the light detector 130 is a signal modification device 140 which converts a photocurrent resulting when light is incident on the light detector 130 into a voltage signal. According to the exemplary embodiment shown here the signal modification device is an amplifier circuit 140 which integrates the photocurrent provided by the light detector. The modified measurement signal provided by the amplifier circuit 140 is processed further by a control device 150.

As can be seen from FIG. 1, an analog-to-digital converter 156 is integrated in the control device 150. The analog-to-digital converter 156 serves for converting an analog output signal of the amplifier circuit 140 into a digital measurement value 156*a* which can be processed further (in a manner not shown here) and can initiate a fire alarm signal, for example, if a certain limit value is exceeded.

The control device 150 additionally includes a driver circuit 170 for the light source 120 which is connected by way of a control line 170*a* to the control device 150 or, more precisely, to the driver circuit 170.

As can also be seen from FIG. 1, the control device 150 furthermore includes an internal temperature measuring diode 158 by which the temperature of the control device 150 and where appropriate also the temperature of the overall smoke detector 100 can be measured. Alternatively or in combination the temperature can also be measured by an external temperature sensor 168. The external temperature sensor 168 can be, for example, a hot-carrier thermal resistor or what is termed an NTC thermistor.

In order to ensure trouble-free operation of the smoke detector 100, a calibration is carried out prior to its being placed into service. In this case a defined scattering body (not shown in FIG. 1) is introduced into the measurement chamber 110 and the digitized output signal 156*a* of the analog-to-digital converter 156 is recorded and compared with a predefined response value. By virtue of the use of a defined scattering body the entire electro-optical signal path inside the smoke detector is registered automatically.

According to the exemplary embodiment described here, the calibration of the electro-optical signal path is accomplished by a single light pulse. As will be described in greater detail below with reference to FIGS. 3A-3C, the signal level of the modified measurement signal output by the amplifier circuit 140 is monitored online in the course of a single illumination pulse and the time interval determined within which a predefined reference level will be reached following the start of the illumination pulse.

Figure 2:
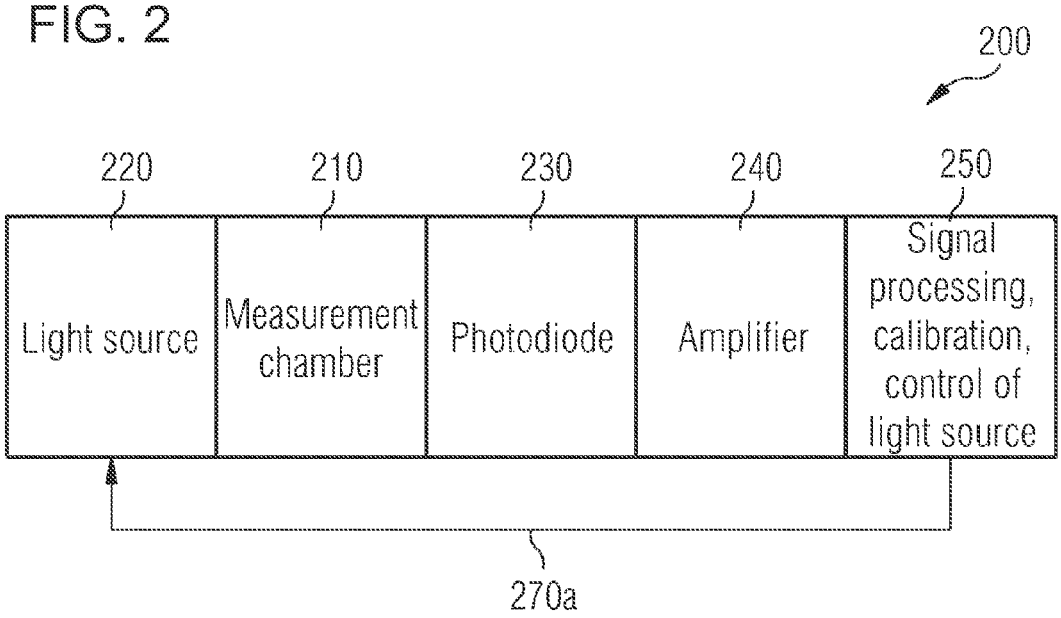
FIG. 2 is a schematic representation of an overall electro-optical signal path within the optical smoke detector shown in FIG. 1.

FIG. 2 shows in a schematic representation the overall electro-optical signal path within the optical smoke detector 100, which is now labeled with reference sign 200. The signal path contains in particular the activation and control of the light source 220 by use of the control device 250, the efficiency of the light source 220, the optical scattering conditions inside the measurement chamber 210, the efficiency of the light detector 230, the amplification of the amplifier circuit 240, and the signal conversion of the analog-to-digital converter within the control device 250.

If it is realized during the calibration that the digitized output signal of the analog-to-digital converter is smaller than envisioned, for example as a result of a relatively low-luminosity light source 220, this is compensated by a corresponding lengthening of the pulse duration of the light pulses. If the output signal of the analog-to-digital converter is greater than envisioned, for example as a result of a particularly high-luminosity light source 220, this can be compensated by a shortening of the pulse duration of the light pulses.

Therefore in the case of the smoke detector 100 described here the calibration is effected, not by way of an adjustment of the amplification of the amplifier circuit 240, but by way of an adjustment of the pulse durations of the illumination pulses emitted by the light source 220.

In order to keep the switch-on time of the light source 220 within predetermined limits, the light source 220 can originate from a preselection of different light sources having defined light outputs, possibly differing in terms of their illuminating efficiency.

Figure 3A:
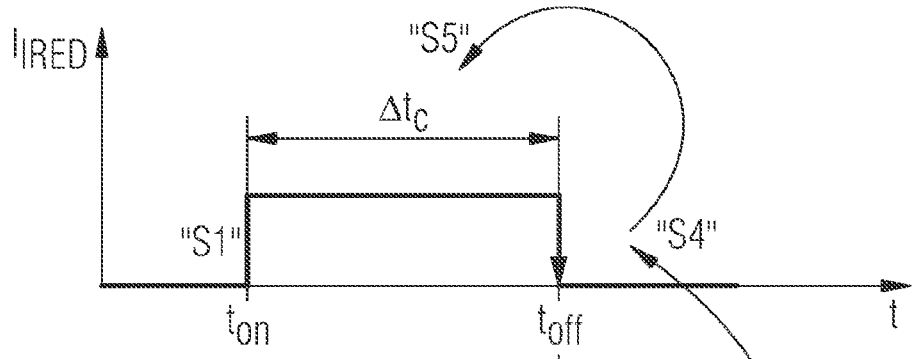
FIGS. 3A-3C are graphs showing time characteristic of different signals during an online calibration of an optical smoke detector by use of a single light pulse.
Figure 3B:
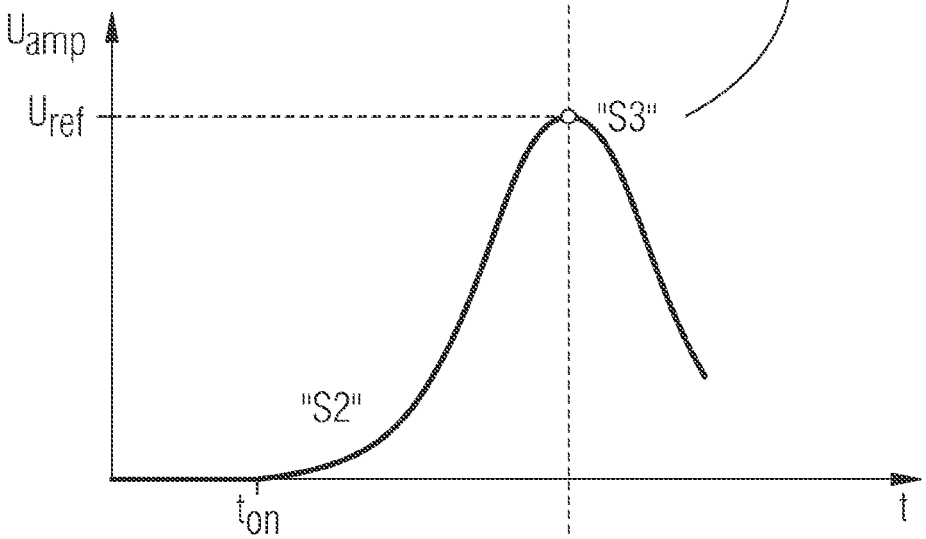
Figure 3C:
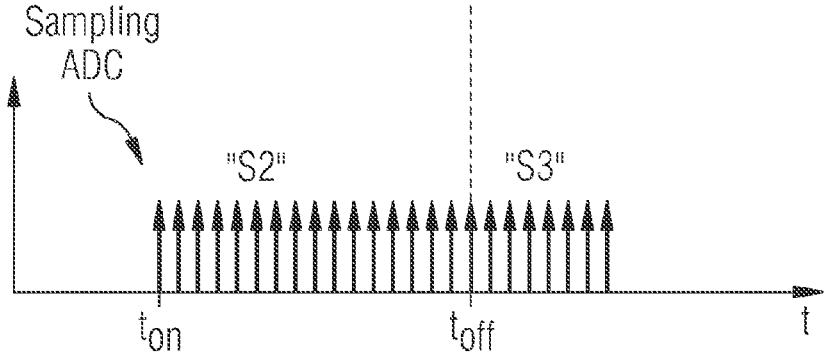

FIGS. 3A-3C show the time characteristics of different signals during an online calibration of the optical smoke detector 100 by a single light pulse. FIG. 3A shows the time characteristic of the current $I_{IRED}$ flowing through the light-emitting diode 120. FIG. 3B shows the time characteristic of the modified measurement signal $U_{amp}$ provided by the amplifier circuit 140. FIG. 3C shows the sampling by the analog-to-digital converter 156. The scaling of the time axes of FIGS. 3A-3C is the same; no offset exists between the time axes of FIGS. 3A-3C. During the described calibration a scattering body having a defined scattering behavior is contained within the measurement chamber 110.

As can be seen from FIG. 3A, the described calibration of the electro-optical signal path begins by an online monitoring of a single light pulse which is switched on at time $t_{on}$ (see "S1"). The corresponding illuminating light emitted by the light-emitting diode 120 is then scattered by the scattering body and impinges on the photodiode 130 as scattered measurement light. The photodiode 130 generates a measurement signal which is indicative of the intensity of the measurement light.

The amplifier circuit 140 now starts to integrate the measurement signal. At the same time the ADC 156 cyclically samples the output signal of the amplifier circuit 140. This is indicated by "S2" in each case in FIGS. 3B-3C.

After a certain time the output signal of the amplifier circuit 140 sampled by the ADC 156 reaches a predefined target voltage swing $U_{ref}$. This is indicated by "S3" in each case in FIGS. 3B-3C. Immediately after the target voltage swing $U_{ref}$ has been reached, the light-emitting diode 120 is switched off again at time $t_{off}$. The integration process is also terminated, with the result that the signal level of the modified measurement signal $U_{amp}$ provided by the amplifier circuit 140 drops again. This is indicated by "S4" in FIG. 3A.

It is pointed out that the sampling of the modified measurement signal $U_{amp}$ by the ADC 156 continues at least until such time as it is ensured that the predefined target voltage swing $U_{ref}$ has also reliably been reached.

The control device 150, which, as shown in FIG. 2, also handles the calibration, now calculates the time difference $\Delta t_c$ between $t_{off}$ and $t_{on}$. This is indicated by "S5" in FIG. 3A. The time difference $\Delta t_c$ corresponds to the duration of the calibration $\Delta t_c$.

During the operation of the smoke detector 100 a current pulse of duration $\Delta t_c$ can then be applied at regular intervals to the light-emitting diode 120. This enables smoke particles that penetrate into the measurement chamber 110 to be detected with a high degree of reliability. An appropriate alarm signal can then be output if a predefined minimum smoke density is exceeded.

The invention claimed is:

1. A sensor device for detecting an object, including optically detecting smoke particles, the sensor device comprising:

a light transmitting device for emitting transmit radiation;

a receiving device for receiving receive radiation having scattered radiation generated by means of an at least partial scattering of the transmit radiation by the object, and for outputting a measurement signal indicative of the receive radiation;

a signal modification device for modifying the measurement signal and for outputting a modified measurement signal, a level of the modified measurement signal increasing after said light transmitting device has been switched on; and a control device for monitoring the modified measurement signal, said control device embodied to detect a reaching of a predefined signal level for the modified measurement signal and to determine a time interval between a switching on of said light transmitting device and the reaching of the predefined signal level;

said control device coupled to said light transmitting device, said control device configured to apply at least one pulse to said light transmitting device, wherein a pulse duration of said pulse is correlated with the time interval between the switching on of said light transmitting device and the reaching of the predefined signal level.

2. The sensor device according to claim 1, wherein said signal modification device has an integrating entity.

3. The sensor device according to claim 2, wherein said integrating entity has a capacitor.

4. The sensor device according to claim 1, wherein said signal modification device has an amplifying electronic circuit.

5. The sensor device according to claim 1, wherein said control device has an analog-to-digital converter by which the modified measurement signal can be sampled.

6. The sensor device according to claim 1, wherein said light transmitting device has a light-emitting diode.

7. The sensor device according to claim 1, wherein said receiving device has a photodiode.

8. A hazard detector for detecting a hazardous situation, including for detecting smoke in a monitored space, the hazard detector comprising:

a sensor device containing:

a light transmitting device for emitting transmit radiation;

a receiving device for receiving receive radiation having scattered radiation generated by means of an at least partial scattering of the transmit radiation by the object, and for outputting a measurement signal indicative of the receive radiation;

a signal modification device for modifying the measurement signal and for outputting a modified measurement signal, a level of the modified measurement signal increasing after said light transmitting device has been switched on; and a control device for monitoring the modified measurement signal, said control device being embodied to detect a reaching of a predefined signal level for the modified measurement signal and to determine a time interval between a switching on of said light transmitting device and the reaching of the predefined signal level;

said control device coupled to said light transmitting device, said control device configured to apply at least one pulse to said light transmitting device, wherein a pulse duration of said pulse is correlated with the time interval between the switching on of said light transmitting device and the reaching of the predefined signal level.

9. A method for calibrating a sensor device for detecting an object, including for optically detecting smoke particles, the method which comprises the steps of:

switching on a light transmitting device so that transmit radiation is emitted;

at receiving device, receiving receive radiation having scattered radiation generated by means of an at least partial scattering of the transmit radiation by the object;

outputting a measurement signal from the receiving device indicative of the receive radiation;

in a signal modification device, modifying the measurement signal so that a level of a modified measurement signal increases;

monitoring the modified measurement signal with a control device, a reaching of a predefined signal level for the modified measurement signal being detected; and in the control device, determining a time interval between a switching on of the light transmitting device and the reaching of the predefined signal level; and in the control device, correlating a pulse duration of at least one pulse to be applied to the light transmitting device with the time interval between the switching on of the light transmitting device and the reaching of the predefined signal level.

10. The method according to claim 9, which further comprises introducing a scattering reference object into a measurement space of the sensor device so that the object will be impinged upon by the transmit radiation and will generate the receive radiation.

11. The sensor device according to claim 1, wherein said control device is configured to activate said light transmitting device to calibrate an electro-optical signal path and said control device is configured to activate said light transmitting device to detect the object.

12. The hazard detector according to claim 8, wherein said control device is configured to activate said light transmitting device to calibrate an electro-optical signal path and said control device is configured to activate said light transmitting device to detect the object.

13. The method according to claim 9, which further comprises: with the control device, activating the light transmitting device to calibrate an electro-optical signal path and activating the light transmitting device to detect the object.

14. The method according to claim 9, which further comprises: with the control device, setting the pulse duration to be equal to the time interval between the switching on of the light transmitting device and the reaching of the predefined signal level.

15. The sensor device according to claim 1, wherein said control device is configured to set the pulse duration to be equal to the time interval between the switching on of the light transmitting device and the reaching of the predefined signal level.

16. The sensor device according to claim 8, wherein said control device is configured to set the pulse duration to be equal to the time interval between the switching on of the light transmitting device and the reaching of the predefined signal level.

* * * * *